US012221877B2

(12) United States Patent
Kyle et al.

(10) Patent No.: US 12,221,877 B2
(45) Date of Patent: Feb. 11, 2025

(54) POSITION MEASUREMENT SYSTEM FOR CORRELATION ARRAY

(71) Applicant: Halliburton Energy Services, Inc., Houston, TX (US)

(72) Inventors: Donald G. Kyle, Plano, TX (US); Nicholas Cole Ashford, Frisco, TX (US); Adam Harold Martin, Addison, TX (US); Michael Linley Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/161,329

(22) PCT Filed: Oct. 23, 2018

(86) PCT No.: PCT/US2018/057129
§ 371 (c)(1),
(2) Date: Jan. 28, 2021

(87) PCT Pub. No.: WO2020/086065
PCT Pub. Date: Apr. 30, 2020

(65) Prior Publication Data

US 2021/0324732 A1 Oct. 21, 2021

(51) Int. Cl.
*E21B 47/092* (2012.01)
*E21B 47/053* (2012.01)

(52) U.S. Cl.
CPC ..... *E21B 47/092* (2020.05); *E21B 47/053* (2020.05)

(58) Field of Classification Search
CPC ..... E21B 47/092; E21B 47/053; E21B 47/09; E21B 47/12; E21B 49/081
See application file for complete search history.

(56) References Cited

U.S. PATENT DOCUMENTS 5,279,366 A * 1/1994 Scholes ..... E21B 43/119 250/257
5,285,065 A * 2/1994 Daigle ..... G01V 15/00 250/303

(Continued)

FOREIGN PATENT DOCUMENTS

EP 2317071 5/2011
EP 3181810 6/2017

(Continued)

OTHER PUBLICATIONS

SRWO International Search Report and Written Opinion for PCT/US2018/057129 dated Jul. 17, 2019.

(Continued)

*Primary Examiner* — Nicole Coy
*Assistant Examiner* — Nicholas D Wlodarski
(74) *Attorney, Agent, or Firm* — John Wustenberg; C. Tumey Law Group PLLC

(57) ABSTRACT

This disclosure may generally relate to operations performed in a wellbore. More particularly, systems and methods may be provided for measuring the position of a tool and/or tubular string downhole. The present disclosure may be able to determine an accurate position change in a downhole tool without requiring surface equipment manipulation during measurement acquisition. A position measurement system may comprise a position measurement tool, wherein the position measurement tool comprises a sensor module and a telemetry module; and a marker, wherein the marker emits a signal measured by the sensor module.

18 Claims, 6 Drawing Sheets

(56) References Cited

U.S. PATENT DOCUMENTS

| | | | | |
|---|---|---|---|---|
| 6,257,338 | B1 | 7/2001 | Kilgore | |
| 6,333,699 | B1 * | 12/2001 | Zierolf | E21B 17/006 705/65 |
| 6,435,286 | B1 | 8/2002 | Stump et al. | |
| 6,516,663 | B2 * | 2/2003 | Wong | E21B 47/04 175/45 |
| 7,204,308 | B2 * | 4/2007 | Dudley | E21B 47/09 166/254.1 |
| 9,810,057 | B2 | 11/2017 | Schmidt et al. | |
| 9,869,174 | B2 | 1/2018 | Szpunar et al. | |
| 2002/0010547 | A1 | 1/2002 | Hall | |
| 2004/0156264 | A1 | 8/2004 | Gardner et al. | |
| 2006/0044939 | A1 | 3/2006 | Shah et al. | |
| 2006/0070743 | A1 | 4/2006 | Shah et al. | |
| 2006/0219438 | A1 | 10/2006 | Moore et al. | |
| 2016/0032713 | A1 | 2/2016 | Hallundbaek et al. | |
| 2016/0215610 | A1 | 7/2016 | Lange et al. | |
| 2016/0230505 | A1 | 8/2016 | Garcia et al. | |
| 2016/0265344 | A1 | 9/2016 | Hornsby | |
| 2016/0273348 | A1 | 9/2016 | Echols, III et al. | |
| 2017/0114628 | A1 | 4/2017 | Khalaj Amineh et al. | |
| 2017/0159423 | A1 * | 6/2017 | Merino | E21B 47/12 |
| 2017/0285219 | A1 | 10/2017 | Brady et al. | |
| 2018/0051554 | A1 * | 2/2018 | Werkheiser | E21B 47/04 |
| 2019/0203538 | A1 * | 7/2019 | Wisinger Jr. | E21B 17/041 |
| 2019/0265384 | A1 * | 8/2019 | Jurczyk | G01V 5/145 |
| 2020/0232318 | A1 | 7/2020 | Fripp et al. | |

FOREIGN PATENT DOCUMENTS

| | | | | |
|---|---|---|---|---|
| WO | 2002063138 | | 8/2002 | |
| WO | 2009064655 | | 5/2009 | |
| WO | 2014131132 | | 9/2014 | |
| WO | 2016105406 | | 6/2016 | |
| WO | 2016175777 | | 11/2016 | |
| WO | 2016188623 | | 11/2016 | |
| WO | WO-2016175777 | A1 * | 11/2016 | E21B 43/116 |
| WO | 2019108162 | | 6/2019 | |
| WO | 20190182610 | | 9/2019 | |

OTHER PUBLICATIONS

Metrol Depth-Loc, Wireless Depth Correlation from Metrol.

Schlumberger—UPCT—Universal Perforating and Correlation Tool, 2008.

Halliburton Energy Services—Wireline and Perforating—Wireline gamma logging and depth correlation operations, H06462, Jan. 2012.

Gooneratne et al., "Downhole Applications of Magnetic Sensors", Sensors 2017 (see p. 1).

French Search Report and Written Opinion for Application No. FR1909825, dated Jul. 21, 2021.

* cited by examiner

POSITION MEASUREMENT SYSTEM FOR CORRELATION ARRAY

BACKGROUND

After drilling various sections of a subterranean wellbore that traverses a formation, a casing string may be positioned and cemented within the wellbore. This casing string may increase the integrity of the wellbore and may provide a path for producing fluids from the producing intervals to the surface.

Where multiple zones may be produced (or injected) in a subterranean wellbore, it may be difficult to determine where to properly set a downhole tool for operation. This may be particularly difficult due to the downhole tool being displaced hundreds to thousands of feet below the Earth's surface. Previous systems and methods may have operated in incorrect locations along the wellbore. Typically, adjusting the position of a tool while downhole may require surface equipment manipulation during the measuring process, but there may not be a verification of proper positioning. As a result, there may be potential well damage as operations such as fracturing and perforating create irreparable openings within a lined wellbore. Incorrect location of the tool may waste rig time and may require sealing the potential openings that were misaligned.

BRIEF DESCRIPTION OF THE DRAWINGS

These drawings illustrate certain aspects of some of the examples of the present invention, and should not be used to limit or define the invention.

DETAILED DESCRIPTION

This disclosure may generally relate to operations performed in a wellbore. More particularly, systems and methods may be provided for measuring the position of a tool and/or tubular string downhole. The present disclosure may be able to determine an accurate position change in a downhole tool without requiring surface equipment manipulation during measurement acquisition. Determining an accurate position may be performed by a position measurement tool which may measure a signal produced by a designated marker to determine position in a wellbore. The position measurement tool and the designated marker may operate and function without contacting each other. This feature may be beneficial as traditional sensors require contact, impeding the functionality of a device being measured.

Figure 1:
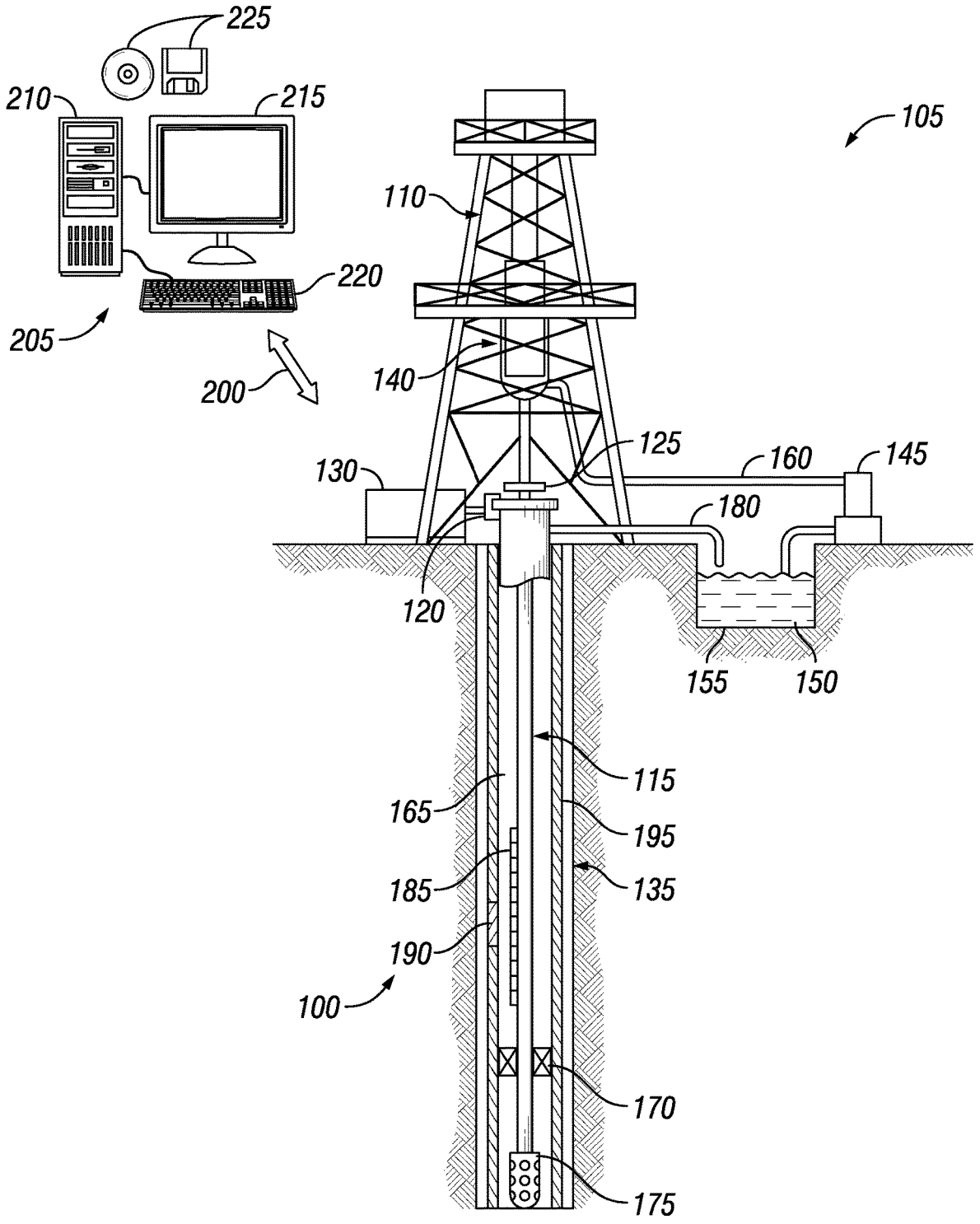
FIG. 1 illustrates a well completion system.

FIG. 1 illustrates a position measurement system 100 disposed within a well completion system 105 which may embody principles of this disclosure. However, it should be clearly understood that well completion system 105 and the associated methods are merely one example of an application of the principles of this disclosure in practice, and a wide variety of other examples are possible. Therefore, the scope of this disclosure is not limited at all to the details of well completion system 105 described herein and/or depicted in the drawings. Without limitations, other applications may include measuring the position of a downhole valve, the amount of sample volume captured within a downhole sampling tool, the change in position of a movable piston, and/or the like.

Well completion system 105 may include a derrick or rig 110, which may be located on land, as illustrated, or atop an offshore platform, semi-submersible, drill ship, or any other suitable platform. Rig 110 may carry a tubular string 115, which may be a drill string, perforating string, or any other suitable tubular conveyance, for example. Rig 110 may be located proximate well head 120. Rig 110 may also include rotary table 125, rotary drive motor 130 and other equipment associated with rotation of tubular string 115 within a wellbore 135. For some applications, rig 110 may include top drive motor or top drive unit 140. Blow out preventers (not illustrated) and other equipment associated with drilling wellbore 135 may also be provided at well head 120. In examples, wellbore 135 may be at least partially uncased and/or open-hole. While wellbore 135 is shown extending generally vertically, the principles described herein may also be applicable to wellbores that extend at an angle, such as horizontal and slanted wellbores. For example, although FIG. 1 shows a vertical or low inclination angle well, high inclination angle or horizontal placement of the well and equipment is also possible.

One or more pumps 145 may be used to pump drilling fluid 150 from fluid reservoir or pit 155 via conduit 160 to the uphole end of tubular string 115 extending from well head 120. Wellbore annulus 165 is formed between the exterior of tubular string 115 and the inside diameter of wellbore 135. The downhole end of tubular string 115 may carry one or more downhole tools (e.g., packer 170 or perforating gun 175), which may also include a bottom hole assembly, mud motor, drill bit, fishing tool, sampler, sub, stabilizer, drill collar, tractor, telemetry device, logging device, or any other suitable tool(s). Drilling fluid 150 may flow through a longitudinal bore (not illustrated) of tubular string 115 and exit into wellbore annulus 165 via one or more ports. Conduit 180 may be used to return drilling fluid 150, reservoir fluids, formation cuttings and/or downhole debris from wellbore annulus 165 to fluid reservoir or pit 155. Various types of screens, filters and/or centrifuges (not shown) may be provided to remove formation cuttings and other downhole debris prior to returning drilling fluid 150 to pit 155.

In examples, position measurement system 100 may comprise a position measurement tool 185 and a marker 190. Position measurement tool 185 may be positioned along tubular string 115 to perform a depth correlation of tubular string 115 in relation to wellbore 135, according to certain illustrative examples of the present disclosure. In certain examples, position measurement tool 185 may be configured to measure a signal from marker 190 disposed at a known location. As illustrated, marker 190 may be located inside a casing 195 or adjacent thereto (e.g., inside a formation) at some known depth. In preferable examples, marker 190 may be disposed within a separate tubular or tool assembly. Thus, in certain examples, the length of position measurement tool 185 is at least as long as the tool proximity error with the measurement range in relation to the true position of marker 190. A gamma plot may be produced by position measurement tool 185 and then communicated to the surface using a suitable wired or wireless communication technique.

In examples, measurements concerning a depth correlation may be processed downhole and/or at the surface. Any suitable technique may be used for transmitting signals containing measurements uphole to the surface. As illustrated, a communication link 200 (which may be wired or wireless, for example) may be provided that may transmit data to an information handling system 205 at the surface. Information handling system 205 may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. For example, an information handling system 205 may be a personal computer, a network storage device, or any other suitable device and may vary in size, shape, performance, functionality, and price. Information handling system 205 may include random access memory (RAM), one or more processing resources such as a central processing unit (CPU) 210 or hardware or software control logic, ROM, and/or other types of nonvolatile memory. Additional components of the information handling system 205 may include one or more disk drives, output devices, such as a video display 215, and one or more network ports for communication with external devices as well as an input device 220 (e.g., keyboard, mouse, etc.). Information handling system 205 may also include one or more buses operable to transmit communications between the various hardware components.

Alternatively, systems and methods of the present disclosure may be implemented, at least in part, with non-transitory computer-readable media 225. Non-transitory computer-readable media 225 may include any instrumentality or aggregation of instrumentalities that may retain data and/or instructions for a period of time. Non-transitory computer-readable media 225 may include, for example, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

In examples, the information handling system 205 may act as a data processing system that analyzes data measurements acquired downhole. This processing may occur at the surface in real-time. Alternatively, the processing may occur at the surface and/or another location after recovery of position measurement system 100 from wellbore 135. Alternatively, the processing may be performed by position measurement tool 185 while downhole in wellbore 135.

Figure 2:
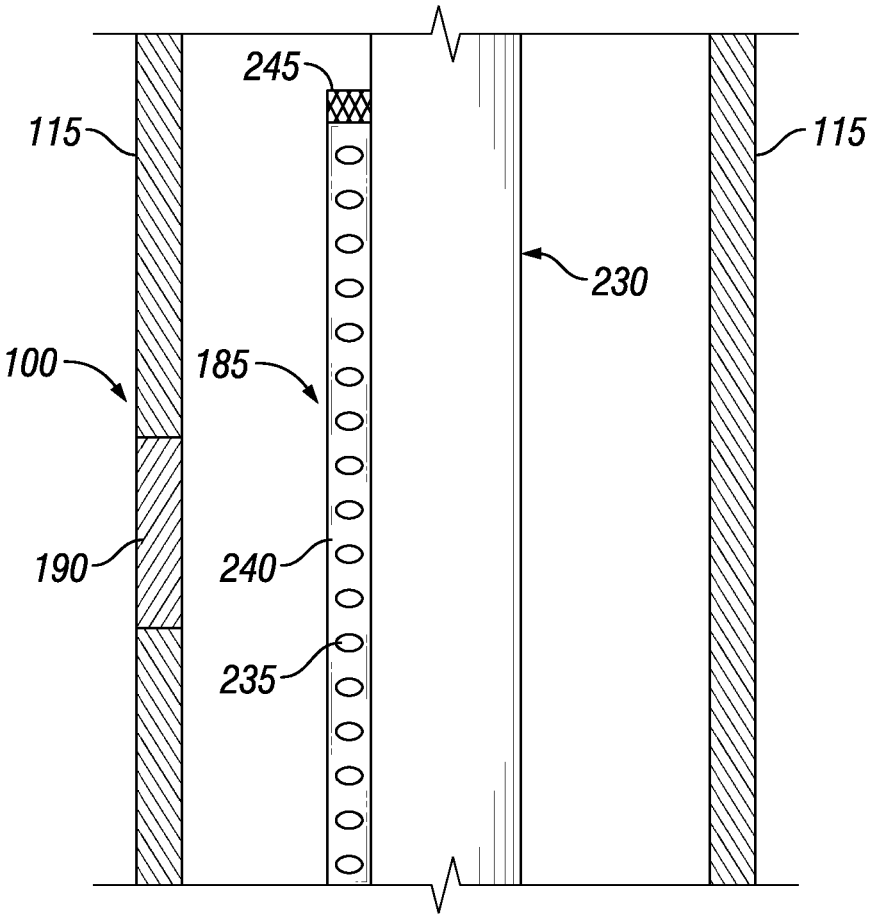
FIG. 2 illustrates a position measurement system incorporated into a well completion system.

FIG. 2 further illustrates how position measurement system 100 may be incorporated into well completion system 105 (i.e., referring to FIG. 1). It may be beneficial to determine a precise location of well completion system 105 prior to undergoing any operations while downhole. Marker 190 placed downhole may serve as a fixed reference point from which reservoir locations may be correlated. This may specifically benefit tool positioning and/or activation in relation to a reservoir location. Position measurement system 100 may comprise position measurement tool 185 and a designated marker 190. In examples, position measurement system 100 may be capable of detecting relative position between position measurement tool 185 and designated marker 190.

Without limitations, position measurement tool 185 may be disposed on a tool assembly 230 and/or within tool assembly 230 near or on a movable structure in tool assembly 230 (i.e., a piston, mandrel, or a sleeve). In alternate examples, position measurement tool 185 may be disposed on the interior of tubular string 115, incorporated within tubular string 115, or on the exterior of tubular string 115. As used herein, the term "tubular string 115" is intended to encompass any suitable tubular string such as a working string, completion string, lower completion string, production string, drill string, coiled tubing, and/or the like. In examples, tool assembly 230 may be disposed downhole through tubular string 115. As illustrated, position measurement tool 185 may be disposed at an exterior of tool assembly 230. Position measurement tool 185 may be disposed onto an exterior of tool assembly 230 using any suitable mechanism, including, but not limited to, through the use of suitable fasteners, threading, clamps, adhesives, welding and/or any combination thereof. Without limitation, suitable fasteners may include nuts and bolts, washers, screws, pins, sockets, rods and studs, hinges and/or any combination thereof. In examples, position measurement tool 185 may be clamped around tool assembly 230. In certain examples, position measurement tool 185 may comprise at least one sensor module 235. Without limitations, sensor module 235 may be a gamma sensor, electromagnetic sensor, acoustic sensor, casing collar locator, and/or combinations thereof. In examples, sensor module 235 may be a gamma sensor, such as a photodiode, Geiger Muller tube, and/or the like.

Position measurement tool 185 may comprise of a plurality of sensor modules 235, a housing 240, and a telemetry module. Without limitations, the number of sensor modules 235 present within position measurement tool 185 may be from about five to about thirty, from about thirty to about fifty, or from about fifty to about seventy-five. In examples, there may be about twenty to about forty sensor modules 235 in position measurement tool 185. The plurality of sensor modules 235 may each be analog, digital, and/or a combination of both. In examples, each of the plurality of sensor modules 235 may be the same type of sensor and/or a different type of sensor. In examples, each sensor module 235 may be a gamma sensor, such as a photodiode, Geiger Muller tube, and/or the like. In alternate examples, each sensor module 235 may be a magnetometer. In certain examples, at least one of the sensor modules 235 may be an accelerometer (not illustrated) used to provide information on movement of position measurement tool 185.

In examples, the plurality of sensor modules 235 may be disposed at spaced apart locations within housing 240 of position measurement tool 185. In some examples, the length of the spaced apart locations may be equidistant. In other examples, the length of the spaced apart locations may vary. Without limitations, the spaced apart locations between the plurality of sensor modules 235 may be between from about half an inch (1.27 cm) to about forty feet (12.2 m). In operations, the plurality of sensor modules 235 may be spaced accordingly to suit the measurement resolution required. As the spacing between the plurality of sensor modules 235 increases, the resolution of the measurements may decrease. Housing 240 may be any suitable size, height, and/or shape. Without limitation, a suitable shape may include, but is not limited to, cross-sectional shapes that are circular, elliptical, triangular, rectangular, square, hexagonal, and/or combinations thereof. Housing 240 may be made from any suitable material. Suitable materials may include, but are not limited to, metals, nonmetals, polymers, ceramics, and/or combinations thereof. Housing 240 may further comprise telemetry module 245.

As illustrated, position measurement tool 185 may comprise telemetry module 245 disposed at a proximal end of housing 240, wherein the proximal end is defined herein as the end closer to the surface. In examples, telemetry module 245 may transmit signals pertaining to downhole data to the surface. Any suitable technique may be used for transmitting signals from position measurement tool 185 to the surface, including, but not limited to, wired pipe telemetry, mud-pulse telemetry, acoustic telemetry, and/or electromagnetic telemetry. Without limitations, an electromagnetic source in telemetry module 245 may be operable to generate pressure pulses in a fluid that propagate along the fluid stream to the surface. In alternate examples, telemetry module 245 may transmit signals to repeaters (not illustrated) disposed along casing 16 (i.e., referring to FIG. 1). The repeaters may be able to receive and/or transmit signals from the surface to position measurement tool 185 (and vice versa). Without limitations, position measurement tool 185 may be able to transmit signals using a wireless communications system. At the surface, pressure transducers (not shown) may convert the pressure signal into electrical signals for a digitizer (not illustrated). The digitizer may supply a digital form of the telemetry signals to information handling system 205 (i.e., referring to FIG. 1) via communication link 200 (i.e., referring to FIG. 1). The telemetry data may then be analyzed and processed by information handling system 205.

As illustrated, marker 190 may be disposed within tubular string 115 at a known location. Marker 190 may be disposed within tubular string 115 prior to, during, or after tubular string 115 is disposed within wellbore 135 (i.e., referring to FIG. 1). Without limitations, marker 190 may be disposed on the interior of tubular string 115, incorporated within tubular string 115, or on the exterior of tubular string 115. Alternatively, marker 190 may be disposed on tool assembly 230 or within tool assembly 230 near or on a movable structure in tool assembly 230 (i.e., a piston, mandrel, or a sleeve). Marker 190 may be disposed using any suitable mechanism, including, but not limited to, through the use of suitable fasteners, threading, adhesives, welding and/or any combination thereof. Without limitation, suitable fasteners may include nuts and bolts, washers, screws, pins, sockets, rods and studs, hinges and/or any combination thereof. In examples, there may be a plurality of markers 104 disposed along tubular string 115. Marker 190 may be any suitable size, height, and/or shape. Without limitation, a suitable shape may include, but is not limited to, cross-sectional shapes that are circular, elliptical, triangular, rectangular, square, hexagonal, and/or combinations thereof. Marker 190 may be made from any suitable material. Suitable materials may include, but are not limited to, metals, nonmetals, polymers, ceramics, and/or combinations thereof. In examples, marker 190 may be made of samarium cobalt. Without limitations, marker 190 may be a radioactive gamma source, RFID tag, magnet, and/or the like. In examples, marker 190 may be a radioactive source configured to emit gamma count. Marker 190 may actively or passively transmit a corresponding signal to position measurement tool 185. In examples, position measurement tool 185 may receive signals emitted by marker 190. Position measurement tool 185 may comprise electronics to record the signals as the signals are detected by at least one of the plurality of sensor modules 235. In examples, the signals emitted by marker 190 and received by position measurement tool 185 may be transmitted to the surface via telemetry module 245.

Figure 3:
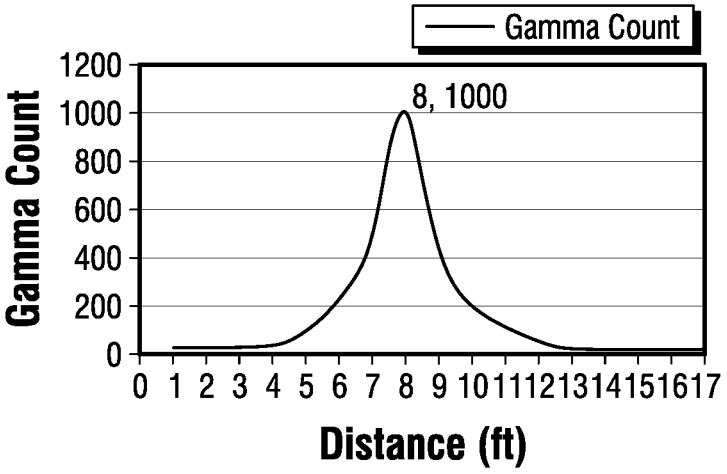
FIG. 3 illustrates a plot of gamma count versus distance.

In examples, the plurality of sensor modules 235 may be actuated to receive and/or record measurements from marker 190. With reference now to FIG. 3, a gamma count versus distance plot may be determined with the measurements acquired by position measurement tool 185 (i.e., referring to FIG. 2). As position measurement tool 185 is disposed near marker 190 (i.e., referring to FIG. 2), each of the plurality of sensor modules 235 (i.e., referring to FIG. 2) may be actuated to record the gamma count radiating from marker 190. In examples, the gamma counts collected by each of the plurality of sensor modules 235 may be plotted versus the known distance between each set of adjacent sensor modules 235 to determine the location of marker 190 in relation to position measurement tool 185, as illustrated in FIG. 3. In examples, a correlation calculation may be performed on the data measurements if marker 190 is located between a set of adjacent sensor modules 235 and not directly adjacent to a singular sensor module 235. In these examples, an interpolation based on empirical data collected may be performed by position measurement tool 185, information handling system 205 (i.e., referring to FIG. 1), and/or by an operator. In examples, an operator may be defined as an individual, group of individuals, or an organization. For example, if marker 190 is located directly between two sensor modules 235, the sensor modules 235 may produce a similar reading. This may indicate that marker 190 is halfway between the two sensor modules 235. In alternate examples, a non-linear interpolation operation may be used as the correlation calculation. Once the gamma count plot has been constructed, the gamma count plot and/or the relative location of the position measurement tool 185 with marker 190 may be sent to information handling system 205 (i.e., referring to FIG. 1) at the surface via telemetry module 245 (i.e., referring to FIG. 2). In examples, an operator may further displace tool assembly 230 (i.e., referring to FIG. 2) if tool assembly 230 is not disposed at the designated location based off the gamma count plot and the relative location of position measurement tool 185 with marker 190. In alternate examples, an operator may actuate tool assembly 230 to perform certain operations downhole if tool assembly 230 is disposed at the designated location.

In examples wherein position measurement tool 185 comprises a singular sensor module 235, a different plot may be constructed. As position measurement tool 185 approaches a tolerance range of marker 190, sensor module 235 may be actuated to receive and/or record measurements from marker 190. In examples, sensor module 235 may be actuated to travel back and forth along a linear path of motion and receive measurements from marker 190 as sensor module 235 travels. Without limitations, sensor module 235 may be displaced by using annular pressure, an electric motor, and/or the like. In examples, the gamma counts collected by sensor module 235 as sensor module 235 is displaced may be plotted versus the distance traveled by sensor module 235 to determine the location of marker 190 in relation to position measurement tool 185. Further processing may be done as telemetry module 245 transmits the plot and/or data to information handling system 205.

Figure 4:
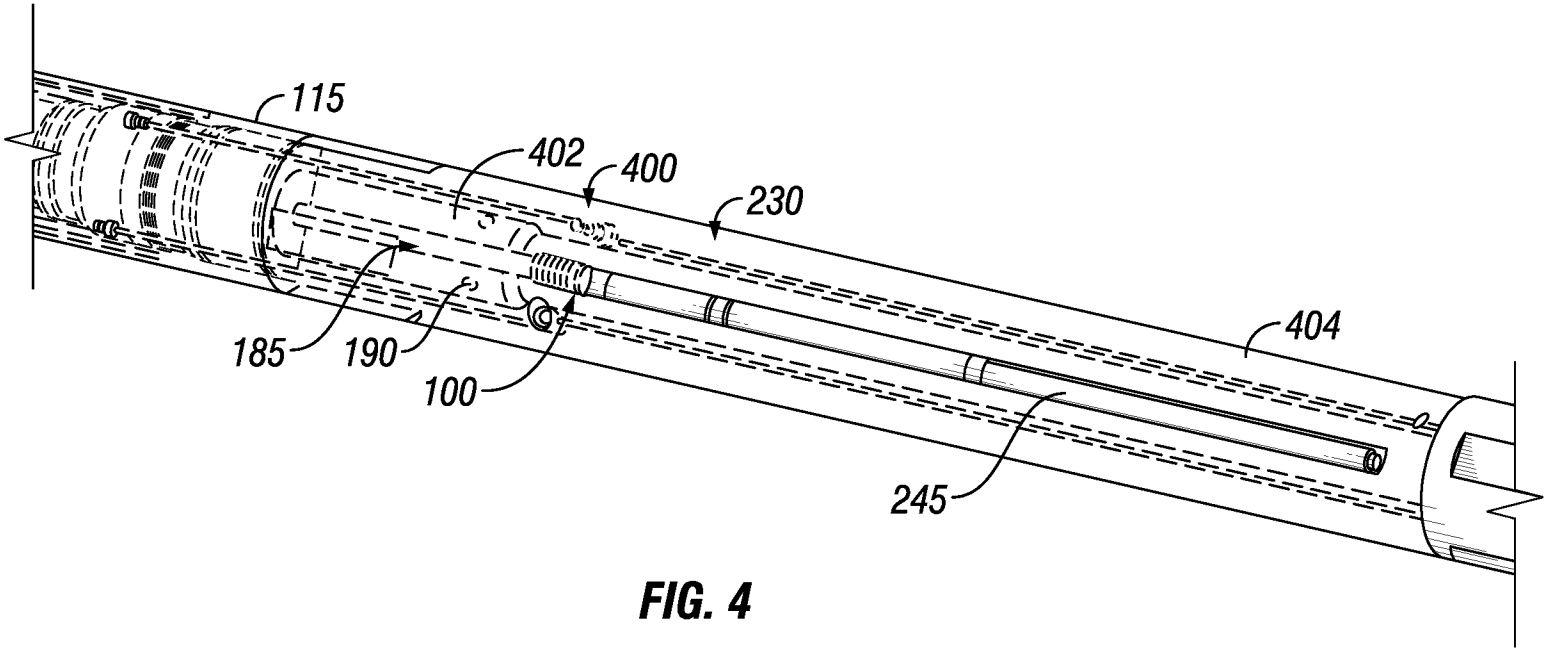
FIG. 4 illustrates an isometric view of a position measurement system incorporated into a tool assembly.
Figure 5:
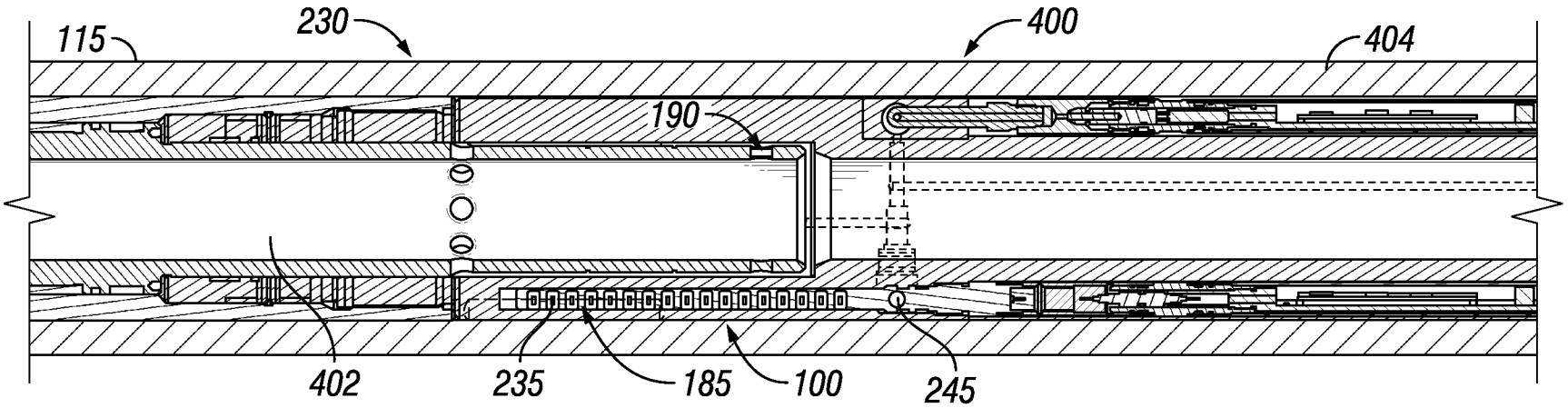
FIG. 5 illustrates a cross-sectional view of a tool assembly showing a position measurement system in relation to the internal components of the tool assembly.

FIGS. 4 and 5 illustrate different views of tool assembly 230. FIG. 4 illustrates an isometric view of position measurement system 100 incorporated into tool assembly 230. FIG. 5 illustrates a cross-sectional view of tool assembly 230 showing position measurement system 100 in relation to the internal components of tool assembly 230. In the present examples, tool assembly 230 may comprise a valve 400. Valve 400 may be used to regulate the flow of drilling fluid 150 (i.e., referring to FIG. 1) through tubular string 115. To actuate valve 400, a mandrel 402 may be used. In examples, mandrel 402 may be actuated to displace back and forth at a proximal end of valve 400. Depending on the position of mandrel 402, valve 400 may be in an open, closed, or circulating position. In examples, the circulating position may indicate that the circulating ports above valve 400 are opened, allowing fluids from wellbore annulus 165 (i.e., referring to FIG. 1) to flow into tubular string 115 above valve 400, wherein valve 400 may be closed. Conversely, fluids may be pumped down tubular string 115, out the circulating ports, and into wellbore annulus 165.

An operator at the surface (i.e., referring to FIG. 1) may be able to determine the position of valve 400 by using position measurement system 100 to verify the location of mandrel 402. In examples, marker 190 may be disposed at a distal end of mandrel 402. As illustrated, position measurement tool 185 may be disposed within a valve housing 404. Position measurement tool 185 may be able to receive signals emitted by marker 190 as position measurement tool 185 is disposed adjacent to marker 190. In examples, as marker 190 displaces along the stroke of mandrel 402, the plurality of sensor modules 235 present within position measurement tool 185 may each measure the gamma count emitted from marker 190. Position measurement tool 185 may transmit the measured gamma count of each sensor module 235 by sending the data to information handling system 205 (i.e., referring to FIG. 1) via telemetry module 245, wherein telemetry module 245 is disposed within valve housing 404 at a distal end of position measurement tool 185. Alternatively, the plurality of sensor modules 235 may be an array of magnetometers and/or inductive switches to detect marker 190 and infer position through an indexed array calculation and/or correlation.

Figure 6:
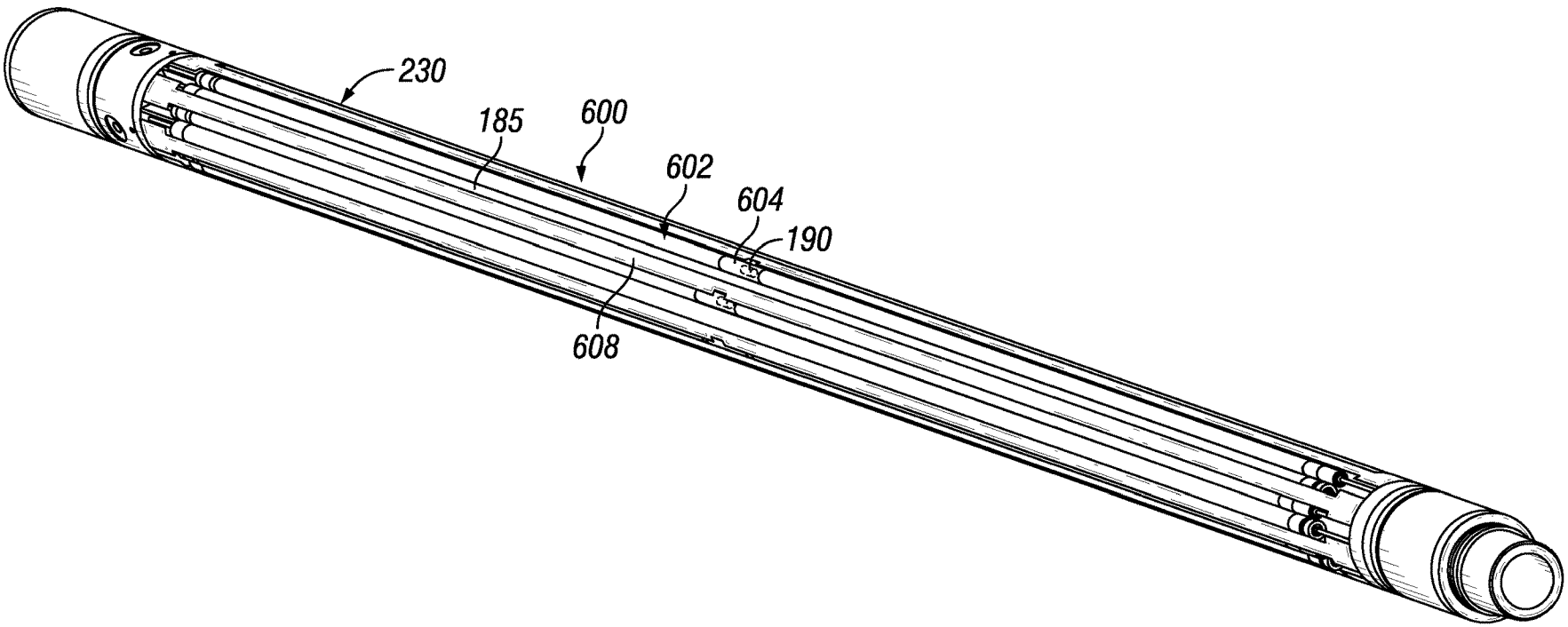
FIG. 6 illustrates an isometric view of a position measurement tool incorporated into a tool assembly.
Figure 7:
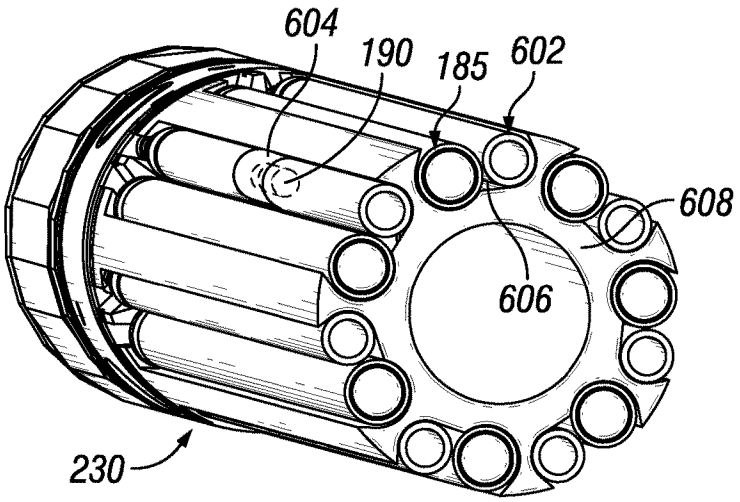
FIG. 7 illustrates a cross-sectional view of a tool assembly with a position measurement tool.
Figure 8:
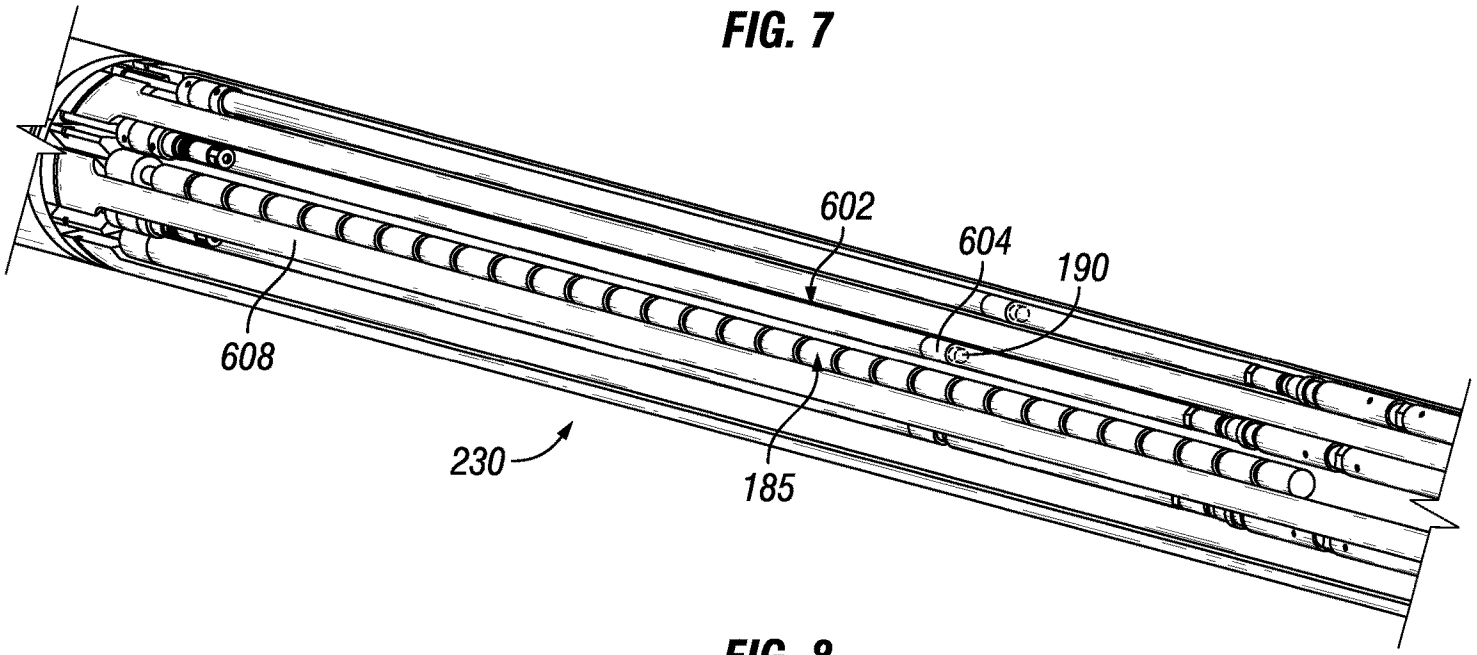
FIG. 8 illustrates an isometric view of a tool assembly collecting a sample of fluid.

FIGS. 6-8 illustrate different views of another example of tool assembly 230. FIG. 6 illustrates an isometric view of position measurement tool 185 incorporated into tool assembly 230. FIG. 7 illustrates a cross-sectional view of tool assembly 230 with position measurement tool 185. FIG. 8 illustrates an isometric view of tool assembly 230 collecting a sample of a reservoir fluid. In the present examples, tool assembly 230 may comprise a downhole sampling tool 600. Downhole sampling tool 600 may be used to acquire a volumetric sample of a reservoir fluid. Downhole sampling tool 600 may comprise of a fluid collection chamber 602, a piston 604, and position measurement tool 185. Fluid collection chamber 602 may be any suitable structure used to contain the reservoir fluid. In examples, fluid collection chamber 602 may be an elongated tubular. There may be a plurality of fluid collection chambers 602 disposed within downhole sampling tool 600. As illustrated, position measurement tool 185 may be disposed adjacent to fluid collection chamber 602. There may be an equivalent number of position measurement tools 102 to fluid collection chamber 602 that acquire measurements from a designated one of fluid collection chambers 602. Both position measurement tool 185 and fluid collection chamber 602 may be disposed in a receptacle 606 of a central support 608 of downhole sampling tool 600, as best illustrated in FIG. 7. Central support 608 may be any suitable size, height, and/or shape to accommodate both position measurement tool 185 and fluid collection chamber 602. In examples, central support 608 may provide structural integrity to tool assembly 230. Central support 608 may have about the same length as position measurement tool 185 and/or fluid collection chamber 602. Central support 608 may be disposed within tool assembly 230 and may be a structure upon which either position measurement tool 185 and/or fluid collection chamber 602 may be disposed.

In operation of downhole sampling tool 600, the reservoir fluid may enter into fluid collection chamber 602. As the reservoir fluid flows into fluid collection chamber 602, the reservoir fluid may push against piston 604 and force piston 604 to displace, wherein piston 604 is disposed within fluid collection chamber 602. In examples, marker 190 may be disposed onto or inside of piston 604. As piston 604 displaces, marker 190 may displace accordingly. Position measurement tool 185 may track the position of marker 190 as marker 190 displaces by measuring the gamma counts emitting from marker 190. In examples, the position of marker 190 may be transmitted to information handling system 205 (i.e., referring to FIG. 1) via telemetry module 245 (i.e., referring to FIG. 2), wherein the volume of the reservoir fluid collected by fluid collection chamber 602 may be calculated using the cross-sectional area of fluid collection chamber 602 and the length traveled by marker 190 inferred from the final position of marker 190. The process may be repeated over a plurality of fluid collection chambers and position measurement tools 185.

The preceding description provides various examples of systems and methods of use which may contain different method steps and alternative combinations of components. It should be understood that, although individual examples may be discussed herein, the present disclosure covers all combinations of the disclosed examples, including, without limitation, the different component combinations, method step combinations, and properties of the system.

Statement 1. A position measurement system, comprising: a position measurement tool, wherein the position measurement tool comprises a sensor module and a telemetry module; and a marker, wherein the marker emits a signal measured by the sensor module.

Statement 2. The position measurement system of statement 1, wherein the position measurement tool is disposed on a tool assembly, wherein the marker is disposed on a tubular string.

Statement 3. The position measurement system of statement 1 or 2, wherein the marker is a radioactive gamma source.

Statement 4. The position measurement system of any of the previous statements, wherein the sensor module is selected from the group consisting of a gamma sensor, electromagnetic sensor, acoustic sensor, and combinations thereof.

Statement 5. The position measurement system of any of the previous statements, wherein the sensor module is a photodiode or a Geiger Muller tube.

Statement 6. The position measurement system of any of the previous statements, wherein the position measurement tool comprises a plurality of sensor modules.

Statement 7. The position measurement system of statement 6, wherein at least one of the plurality of sensor modules is an accelerometer.

Statement 8. The position measurement system of statement 6, wherein the plurality of sensor modules are magnetometers, wherein the marker is a magnet.

Statement 9. The position measurement system of any of the previous statements, wherein the position measurement tool is disposed on a tool assembly, wherein the marker is disposed on an internal component of the tool assembly that is movable.

Statement 10. A method for identifying a position, comprising: disposing a position measurement tool downhole; emitting a signal from a marker, wherein the marker is disposed on a movable structure; receiving the signal through a plurality of sensor modules disposed in the position measurement tool; transmitting the signal uphole through a telemetry module; comparing the signal received at a first sensor module and a second sensor module; and identifying the position between the position measurement tool and the marker.

Statement 11. The method of statement 10, wherein comparing the signal comprises applying a correlation calculation.

Statement 12. The method of statement 10 or 11, wherein each of the plurality of sensor modules is a gamma sensor.

Statement 13. The method of any one of statements 10 to 12, wherein the marker is disposed on a tubular string, wherein the position measurement tool is disposed on a tool assembly.

Statement 14. The method of statement 13, further comprising displacing the tool assembly or the tubular string.

Statement 15. The method of any one of statements 10 to 14, wherein the position measurement tool is disposed on a tool assembly, wherein the marker is disposed on an internal component of the tool assembly that is movable.

Statement 16. The method of statement 15, further comprising of displacing the internal component of the tool assembly.

Statement 17. A downhole system, comprising: a tubular string; a tool assembly disposed within the tubular string; a position measurement system, wherein the position measurement system comprises: a position measurement tool, wherein the position measurement tool comprises a sensor module and a telemetry module; and a marker, wherein the marker is configured to emit a signal; and and information handling system.

Statement 18. The downhole system of statement 17, wherein the position measurement tool is disposed on the tool assembly, wherein the marker is disposed on an internal component of the tool assembly that is movable.

Statement 19. The downhole system of statement 17 or 18, wherein the position measurement tool is disposed on the tool assembly, wherein the marker is disposed on the tubular string.

Statement 20. The downhole system of any one of statements 17 to 19, wherein the signal measured by the sensor module is transmitted to the information handling system via the telemetry module to determine a relative position between the position measurement tool and the marker.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A method for identifying a location of an internal movable structure with respect to a position measurement tool, comprising:

lowering a tubular string into a casing within a wellbore, wherein the tubular string comprises:

the internal movable structure; and the position measurement tool, wherein after lowering the tubular string into the casing, the method further comprises:

performing an operation which causes the internal movable structure to move with respect to the position measurement tool;

receiving by a first sensor module, disposed on the position measurement tool, a first signal from a marker disposed on the internal movable structure;

receiving by a second sensor module, disposed on the position measurement tool, a second signal from the marker; and calculating the location of the internal movable structure with respect to the position measurement tool using the first signal and the second signal.

2. The method of claim 1, wherein after lowering the tubular string and prior to performing the operation, the method further comprises:

lowering the internal movable structure and the position measurement tool to a portion of the wellbore without the casing.

3. The method of claim 1, wherein calculating the location of the internal movable structure, comprises:

calculating a first distance based on the first signal; and calculating a second distance based on the second signal.

4. The method of claim 3, wherein calculating the location of the internal movable structure, further comprises:

interpolating between the first distance and the second distance to calculate the location of the internal movable structure with respect to the position measurement tool.

5. The method of claim 3, wherein the first distance is between the first sensor module and the marker, and wherein the second distance is between the second sensor module and the marker.

6. The method of claim 1, wherein prior to calculating the location of the internal movable structure, the method further comprises:

receiving by a third sensor module, disposed on the position measurement tool, a third signal from the marker.

7. The method of claim 6, wherein calculating the location of the internal movable structure comprises:

plotting the first signal, the second signal, and the third signal against known distances between the first sensor module, the second sensor module, and the third sensor module.

8. The method of claim 7, further comprising:

interpolating between the first signal, the second signal, and the third signal to identify the location of the internal movable structure with respect to the position measurement tool.

9. The method of claim 8, wherein the method further comprises:

making a determination that the internal movable structure is not in a designated location; and based on the determination:

performing a second operation which causes the internal movable structure to move with respect to the position measurement tool.

10. The method of claim 9, wherein the designated location is between the first and third sensor module.

11. The method of claim 10, wherein after performing the second operation, the method further comprises:

verifying that the internal movable structure is in the designated location.

12. A tubular string disposed within a casing, comprising:

an internal movable structure, comprising:

a marker; and a position measurement tool, comprising:

a first sensor module configured to measure a first distance to the marker;

a second sensor module configured to measure a second distance to the marker; and a processor, wherein after being disposed within the casing of a wellbore, the tubular string is configured to:

perform an operation which causes the internal movable structure to move with respect to the position measurement tool, and wherein after the operation, the processor is configured to:

receive, by the first sensor module, a first signal from the marker;

receive by the second sensor module, a second signal from the marker; and calculate a location of the internal movable structure with respect to the position measurement tool using the first signal and second signal.

13. The tubular string of claim 12, wherein the tubular string is further configured to:

calculate the first distance based on the first signal; and calculate the second distance based on the second signal.

14. The tubular string of claim 13, wherein the tubular string is further configured to:

interpolate between the first distance and the second distance to calculate the location of the internal movable structure with respect to the position measurement tool.

15. The tubular string of claim 13, wherein the first distance is between the first sensor module and the marker, and wherein the second distance is between the second sensor module and the marker.

16. The tubular string of claim 12, wherein the tubular string is further configured to:

receive by a third sensor module, disposed on the position measurement tool, a third signal from the marker.

17. The tubular string of claim 16, wherein the tubular string is further configured to:

plot the first signal, the second signal, and the third signal against known distances between the first sensor module, the second sensor module, and the third sensor module.

18. The tubular string of claim 17, wherein the tubular string is further configured to:

interpolate between the first signal, the second signal, and the third signal to identify the location of the internal movable structure with respect to the position measurement tool.

* * * * *